United States Patent [19]

Totten

[11] Patent Number: 4,549,253

[45] Date of Patent: Oct. 22, 1985

[54] LIGHTING FIXTURE

[75] Inventor: Thomas B. Totten, Stouffville, Canada

[73] Assignee: Flexillume Canada Ltd., Markham, Canada

[21] Appl. No.: 514,942

[22] Filed: Jul. 18, 1983

[51] Int. Cl.[4] ..... F21S 1/06

[52] U.S. Cl. ..... 362/364; 362/148; 362/221; 362/310; 362/311

[58] Field of Search ..... 362/148, 221, 310, 311, 362/364

[56] References Cited

U.S. PATENT DOCUMENTS

| | | | |
|---|---|---|---|
| 3,469,089 | 9/1969 | Picha | 362/220 |
| 3,788,206 | 1/1974 | Mulvey | 98/40 |
| 3,865,969 | 2/1975 | Mulvey | 174/48 |
| 4,161,019 | 7/1979 | Mulvey | 362/147 |
| 4,175,360 | 11/1979 | Mulvey | 52/28 |

FOREIGN PATENT DOCUMENTS

| | | |
|---|---|---|
| 735310 | 5/1966 | Canada . |
| 850372 | 9/1970 | Canada . |
| 977603 | 11/1975 | Canada . |
| 994439 | 8/1976 | Canada . |
| 1048221 | 2/1979 | Canada . |
| 1061759 | 9/1979 | Canada . |

*Primary Examiner*—Stephen J. Lechert, Jr.

[57] ABSTRACT

A two part lighting fixture having side walls, and end walls, forming a reflector, supports around the lower edge of such side and end walls, by which the fixture is supported in a ceiling, upper edges of the side and end walls defining an opening, a movable electrical container movably received in the opening, the container being formed of sheet metal of predetermined thickness, for enclosing electrical fittings, and having lighting receptacles and, releaseable supports for the container.

7 Claims, 6 Drawing Figures

LIGHTING FIXTURE

The invention relates to lighting fixtures for use in dropped ceilings, and in particular to such fixtures as are used for supporting elongated tubular lighting elements.

BACKGROUND OF THE INVENTION

The construction of dropped ceilings usually involves the use of a grid of so-called ceiling tees, which are hung below a structural portion of the building usually on wires or rods. Ceiling tiles are laid in the majority of the grid, and at various locations other fixtures such as air handling fixtures, and lighting fixtures are inserted.

In other forms of dropped ceilings, some other form of finishing surface may be provided in some cases, with suitable openings being located at spaced apart points for reception of lighting fixtures.

The installation of such lighting fixtures is usually done from beneath the ceiling. The lighting fixture is raised upwardly and presented to the ceiling at the appropriate opening. It must then be tilted at an angle, and inserted upwardly through the opening, and then lowered back in a horizontal fashion, so that it rests on the supporting fabric of the ceiling.

At the same time, access must be had to the space above the ceiling, so that suitable electrical connections can be made to wiring harnesses and the like which are located in the space above the ceiling.

In some cases, air handling slits or openings are provided around such lighting fixtures, and in some cases it is also necessary to attach air handling duct work and the like to such slits.

The most popular size of lighting fixture employed in such ceilings is a fixture which measures 2 ft. by 4 ft., and fits in the typical grid of ceiling tees. However in other ceiling designs, lighting fixtures may be employed which are 2×2 or 4×4, or may be of a custom design shape, depending upon the specifications of the architects and consulting engineers involved. In the past, the weight of the lighting fixtures has been considerable, and consequently the work involved in installing and positioning the lighting fixtures in the ceiling openings is relatively speaking exhausting, and usually requires two men per fixture. One of the principal limiting factors in the design of such lighting fixtures is of course that they must meet severe product specifications laid down by various authorities such as the Underwriters' Laboratory and national standards associations in various countries. These standards are imposed both to provide electrical safety in the system in the event of failure of a component such as a ballast, insulation or the like, and also to provide resistance to fire, and heat developed by the lighting elements.

In order to meet these specifications, it is necessary to employ relatively heavy gauge metal in the construction of such lighting fixtures, and this greatly adds to the weight and also to the expense of the lighting fixtures themselves.

Another factor is the degree and intensity of lighting which is to be provided in a particular building space. The type of work carried on in a building space, the height of the ceiling above the work area, and the degree of available natural light and the like are all factors which must be taken into account. However, there are certain minimum standards which are generally accepted in the industry for the design of typically commercial buildings such as office spaces, showrooms and the like, which require a relatively high degree of lighting intensity.

In order to provide this degree of lighting intensity it is necessary to provide lighting elements at relatively frequent intervals throughout the ceiling, and also to provide lighting elements having a fairly high degree of lighting intensity.

The provision of such relatively high intensity lighting carries with it additional problems. It is found from experience and numerous tests that the use of relatively high intensity lighting in such ceilings creates stresses on the persons working in the work area. Efforts have been made in the past by the provision of various designs of lenses and the like to ensure that the intensity of the lighting is directed to the area beneath the light fixture itself. Areas displaced more than a certain angular distance away from the lighting fixture are generally speaking subject to a reduced intensity lighting. The object of this is to ensure that persons walking about the space or looking about from one area to another, will not find that their eyes are constantly receiving high intensity lighting at a relatively low angle from more distant lighting fixtures.

However, the various expedients used to provide this desirable characteristic, which may be characterized simply as the reduction of low angle incident light, have not generally speaking been totally satisfactory.

One expedient that has been particularly successful is to locate the lighting elements in upwardly recessed areas in the ceiling known as "coffers." The provision of such upwardly recessed coffers provides a simple solution to the problem of low angle glare. Since the tubes themselves are located in the upwardly directed recesses, all light from the tubes beyond a certain predetermined angle, is simply cut off altogether. In practice it is found that the use of a coffered ceiling system greatly increases the aesthetic appeal of the ceiling, and also adds somewhat to the variety of the surface appearance, and reduces stresses on persons working the building space.

However, coffered ceilings have been found to be relatively expensive to construct. In particular, they are found to be unusually labour intensive, and consequently have not found wide acceptance.

An additional factor in the design of such lighting fixtures is the transportation of such fixtures from the factory to the work site. The coffered ceiling lighting fixtures such as have been available in the past, have a relatively considerable height dimension. Since most of this dimension consists of empty space, it is readily apparent that the shipping of such coffered lighting fixtures is relatively inefficient and therefore expensive.

It is therefore clearly desirable to provide an improved form of lighting fixture which both provides for a recessed or coffered ceiling effect, and which at the same time can be fabricated at least in part of more economical thin gauge sheet metal, and which also provides for a partially knocked down form of construction, such that it may be shipped in such a manner that it occupies less space than when it is set up.

BRIEF SUMMARY OF THE INVENTION

With a view to overcoming the various disadvantages described above, the invention therefore comprises a lighting fixture of two part construction, and having a pair of opposed side walls, and end walls forming reflector means enclosing four sides of a space, and having support means around the lower edge of such side and end walls by means of which such fixture may be supported in a ceiling, and such side walls and end walls having upper edges defining a generally rectangular opening, a generally rectangular electrical container having side walls, end walls and top and bottom walls, for enclosing electrical fittings, and having lighting receptacle means extending downwardly from such container below such bottom wall for reception of electrical lighting elements therein, such container being removably received in such opening.

More particularly, it is an objective of the invention to provide such a lighting fixture wherein the side walls of such container are arranged in an upwardly converging manner, so as to provide a generally trapezoidal shape in section, with such lighting elements located in the upper narrower portion of such shape, and including lens attaching means formed in said side walls between their upper and lower edges.

More particularly, it is an objective of the invention to provide such a lighting fixture wherein the electrical container is of generally rectangular shape, for containing electrical fixtures, and for supporting the lighting receptacles, and wherein said recessed housing is formed separately from said electrical fixture, and is formed of lighter gauge light weight material, such electrical container being telescopically retractable in said recessed housing to form a composite lighting fixture.

It is a further and related objective of the invention to provide a lighting fixture of the type described, wherein such recessed housing has side walls and end walls which define an upper opening of a predetermined shape adapted to receive such an electrical container, and said electrical container is telescopically movable between an upper operative position, and a lower storage position, and including fastening means for fastening same in said upper position, and including further fastening means for fastening same in said lower position, whereby the same may be shipped and stored in a partially knocked down condition, in which the two parts are fastened together, and wherein such two parts may be released, and moved into their operative position, and again fastened.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 6:
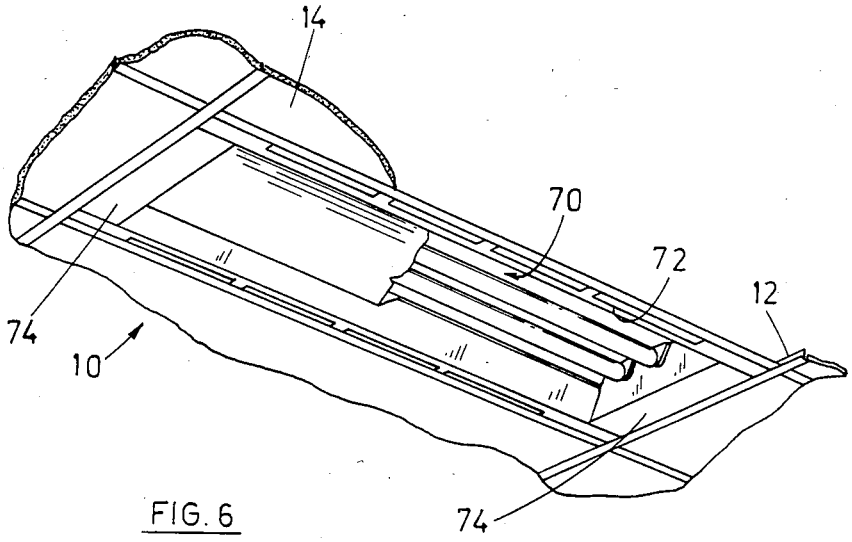
Figure 4:
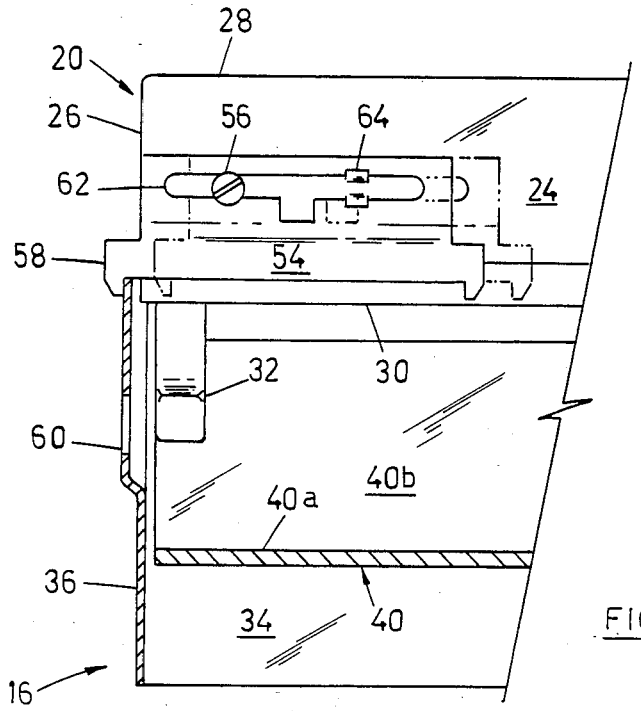
FIG. 4 is a side elevation of the fastening means and container in an upper position.
Figure 5:
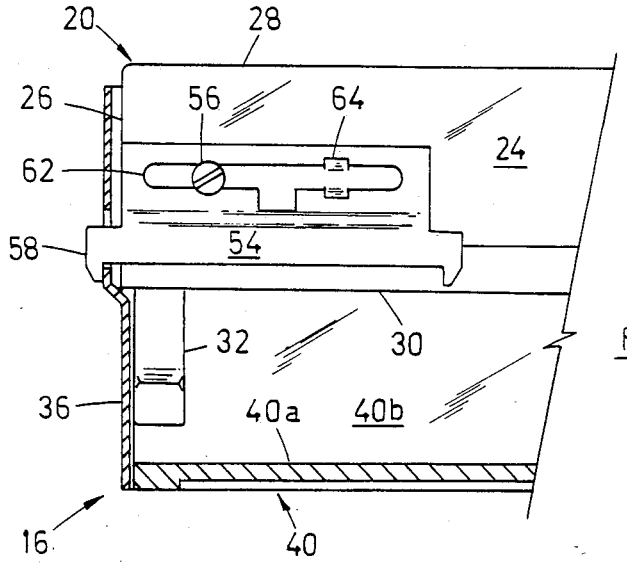

FIG. 5 corresponds to FIG. 4 in the lower position, and,

FIG. 6 is a lower perspective of an alternate embodiment.

DESCRIPTION OF A SPECIFIC EMBODIMENT

Figure 1:
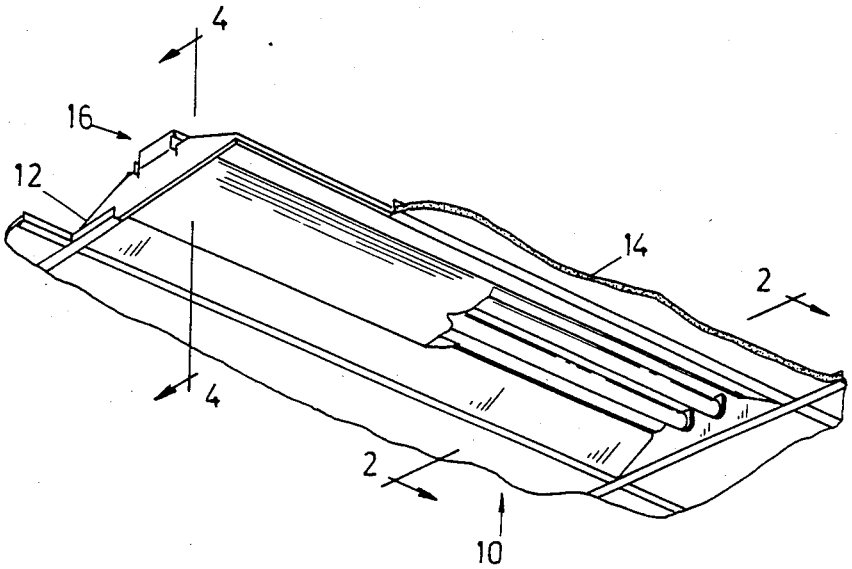
FIG. 1 is a lower perspective illustration showing a portion of a ceiling, and a recessed lighting fixture in accordance with the invention shown in place therein.

Referring now to FIG. 1, it will be seen that a ceiling is shown of a typical design and indicated generally as 10. It consists of a grid of ceiling tees indicated as 12 consisting of longitudinal members and cross members. The details of such a ceiling grid are well known in the art and require no further description.

Typical rectangular ceiling tiles or panels of acoustic or the like material indicated generally as 14 are provided.

The ceiling tees are arranged so as to provide rectangular spaces between them, and in some such rectangular spaces lighting fixtures indicated generally as 16 are supported.

In the case of some ceiling designs, the lighting fixtures may incorporate air handling openings (FIG. 6), along either side of the fixture, for either delivery of fresh air or return of used air. Such openings may be connected in some cases to air handling facilities within the ceiling space, or may simply communicate directly with the ceiling space, depending upon the design of the air handling facilities in the building. All of these details are well known in the art and require no further description.

The construction of the lighting fixture 16 is shown in more detail with reference to FIGS. 2 to 5.

Figure 2:
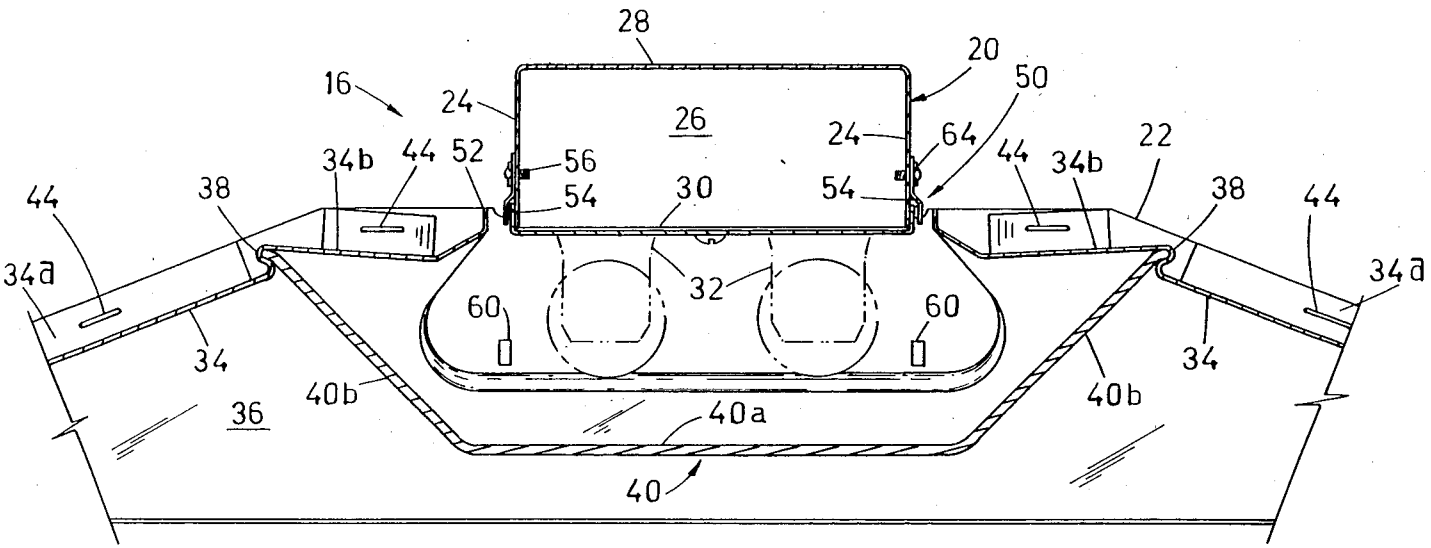
FIG. 2 is a section along the line 2—2 of the lighting fixture in FIG. 1, showing the same in its operative position.
Figure 3:
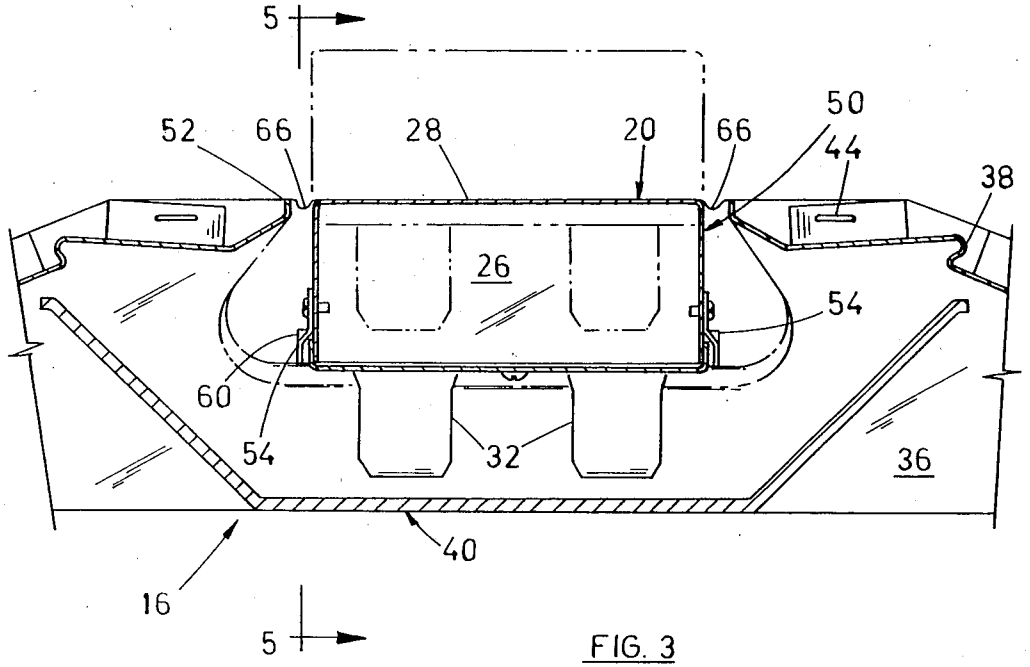
FIG. 3 is a section similar to FIG. 2, showing such lighting fixture in its knocked down shipping condition.

As shown in FIG. 2, the lighting fixture 16 consists of two separate components, namely an electrical container or box indicated generally as 20, and a recessed housing indicated generally as 22.

The box 20 is a standard lighting industry component having side walls 24, end walls 26, a top wall 28 and bottom wall 30. Lighting element receptacles 32 extend downwardly to receive suitable lighting tubes.

Together they define an overal minimum height which must be accomodated, in some measure, for shipping and storage.

Electrical wiring and components are located within box 20. Other forms of lighting may require boxes of different shape and function, the rectangular shape shown here being merely by way of illustration. A heavy gauge metal is use appropriate to its function.

The recessed housing 22 according to the invention comprises a pair of reflector side walls 34 and end walls 36. Side walls 34 are arranged at **34*a* in a downwardly divergent manner as shown, and have flattened upper portions 34*b*** in a horizontal plane.

Lens retaining means such as folded grooves 38 are formed in walls 34 close to the transition between angled portions **34*a* and flattened portions 34*b***.

A lens 40 having a horizontal centre panel **40*a* and upwardly angled side panels 40*b* makes a snap fit in grooves 38**, and is releasable for replacement of tubes.

Ends walls 36 are also arranged at a downwardly divergent angle, in this case, although in other cases they may be vertical depending upon the design of the ceiling module, and lighting effect desired.

In the embodiment shown, end walls 36 and side walls 34 are joined by seams 42 at all four corners, and such seams are secured by stapes 44. Walls 34 and 36 are of light-gauge sheet metal, thinner than the gauge of box 20, since they are not part of the electrical container.

Walls 34 and 36 form a larger, downwardly directed opening 48, and a smaller, upwardly directed opening 50, such openings being defined by the lower and upper edges of such walls.

The downwardly directed opening 48 permits the diffusion of light in the area beneath the ceiling by the lens, and angled side walls. Light rays beyond a predetermined angle are trapped by such side and end walls, and this effectively reduces low angle glare or dazzling.

The upwardly directed opening 50 is typically surrounded by edge flanges 52 and is dimensioned to receive box 20 in a telescopically retractable manner.

The dimensions of opening 50 are such that box 20 is telescopically movable, within such opening, between an upper extended in-use position (FIG. 2) and a lower, retracted storage position (FIG.).

The box 20 can be releasably fastened in at least one, and preferably in both positions.

Fastening means are provided which comprise the four slotted slide members 54, slidably mounted on box 20 at its four corners by screws or ribets 56. Tabs 58 on members 54 may be extended and withdrawn by sliding members 54 out or in.

In the upper operative position (FIG. 2), tabs 58 overlie the upper edges of flanges 52 on end walls 36.

Tabs 58 are formed in the shape of downwardly directed hooks so as to retain themselves in either position.

Slots 62 are formed in members 54 to receive rivets 56. Guide flanges 64 extend out from box 20 to fit in slots 62 to control movement. Openings 66 formed in members 54 permit flanges 64 to be inserted during manufacture.

Notches 68 are formed in the upper edges of end walls 36 to locate tabs 58, when the box is in its upper position.

In operation, the box 20 is located in its lower position for packaging in a carton. In this way, the carton occupies less space and is more economical for shipping and storage.

At the building site the box 20 is raised to its upper position for installation in the ceiling.

An alternate embodiment is shown in FIG. 6. In this case, the same basic components of the ceiling are shown with the same references. The lighting fixture 70 is shown as having air openings 72 on either side, although this is an optional feature. The fixture 70 differs from fixture 16 in that it is adapted to fit a different sized ceiling grid. End panels 74 are attached to end walls 76 and thus extend the length of the fixture to fill the longer ceiling module. The end walls 76 may also be formed in an downwardly divergent fashion to achieve a greater spread of light.

The foregoing is a description of a preferred embodiment of the invention which is given here by way of example only. The invention is not to be taken as limited to any of the specific features as described. but comprehends all such variations thereof as come within the scope of the appended claims.

What is claimed is:

1. A telescopic, retractable lighting fixture for use in ceilings for providing an illuminated recess in such a ceiling, and comprising, an electrical component container having predetermined length, width and height dimensions;

lamp receiving receptacles extending downwardly below such container and together with such height dimension, defining a predetermined minimum storage height;

housing means for defining such a ceiling recess, for mounting in such ceiling, such housing means having side walls and having a lower opening directed downwardly, with such side walls extending upwardly above the plane of such ceiling and defining a predetermined recess depth;

upper opening means defined in an upper portion of said housing means, said upper opening means being shaped to telescopically receive said electrical container therein, said electrical container being telescopically movable within said upper opening means between upper extended and lower retracted position, said upper retracted position providing a shipping and storage function wherein said electrical component housing and electrical receptacles are stored with their storage height contained within the depth dimension of said housing, whereby said lighting fixture has a lower overall height for shipping and storage, and a greater overall height when in use, and, fastening means for fastening said electrical container relative to said housing means, in said upper extended position.

2. A telescopic retractable lighting fixture as claimed in claim 1 including second fastening means for fastening said container to said housing in said lower retracted position.

3. A telescopic retractable lighting fixture as claimed in claim 2 wherein said fastening means comprise, movable support members on said container at spaced points therearound, and first receiving means on said housing adjacent said upper opening means, and second receiving means on said housing below said upper opening, said receiving means being adapted to receive said support members in respective upper and lower positions of said container.

4. A telescopic retractable lighting fixture as claimed in claim 1 wherein the side walls of said housing means are arranged in an upwardly converging manner, so as to provide a generally trapezoidal shape in section, with said container being located in the upper narrower portion of said shape, and including lens attaching means formed in said side walls between their upper and lower edges.

5. A telescopic retractable lighting fixture as claimed in claim 1 including releaseable supporting means on said container for supporting same in said opening, said supporting means being movable towards and away from said housing means.

6. A telescopic retractable lighting fixture as claimed in claim 4 wherein said side walls are formed with upper portions in a common horizontal plane, and lower portions angled in a downwardly divergent manner, and wherein said lens attaching means are formed by infolded wall portions along the juncture between such upper and lower wall portions.

7. A telescopic retractable lighting fixture as claimed in claim 6 including a lens of generally channel shape, having a generally horizontal centre wall panel, and side wall panels angled away from said centre wall panel, and edge formations on said side wall panels engageable with said lens attaching means.

* * * * *